US007884780B2

(12) United States Patent
Kang

(10) Patent No.: US 7,884,780 B2
(45) Date of Patent: Feb. 8, 2011

(54) ELECTRON EMISSION DISPLAY DEVICE AND VIDEO DATA REVISION METHOD

(75) Inventor: Mun Seok Kang, Anyang (KR)

(73) Assignee: Samsung SDI Co., Ltd., Yongin-si (KR)

( * ) Notice: Subject to any disclaimer, the term of this patent is extended or adjusted under 35 U.S.C. 154(b) by 979 days.

(21) Appl. No.: 11/688,214

(22) Filed: Mar. 19, 2007

(65) Prior Publication Data

US 2007/0285581 A1 Dec. 13, 2007

(30) Foreign Application Priority Data

Apr. 7, 2006 (KR) ..... 10-2006-0032074

(51) Int. Cl.
*G09G 3/20* (2006.01)
*G09G 3/22* (2006.01)

(52) U.S. Cl. ..... 345/74.1; 345/77

(58) Field of Classification Search ..... 345/74.1, 345/75.1, 76–100, 209
See application file for complete search history.

(56) References Cited

U.S. PATENT DOCUMENTS

| | | | | |
|---|---|---|---|---|
| 6,304,241 | B1 * | 10/2001 | Udo et al. | 345/96 |
| 7,573,449 | B2 * | 8/2009 | Aoki | 345/89 |
| 7,792,286 | B2 * | 9/2010 | Futa et al. | 380/28 |
| 2002/0186386 | A1 * | 12/2002 | Kawanabe et al. | 358/1.8 |
| 2004/0197081 | A1 * | 10/2004 | Ueda et al. | 386/65 |
| 2005/0206636 | A1 * | 9/2005 | Kanai | 345/204 |

FOREIGN PATENT DOCUMENTS

| | | |
|---|---|---|
| JP | 2001-77376 A | 3/2001 |
| JP | 2001-290461 | 10/2001 |
| JP | 2005-221525 | 8/2005 |

OTHER PUBLICATIONS

Patent Abstracts of Japan, Publication No. 2001-290461; Publication Date: Oct. 19, 2001; in the name of Muneyoshi et al.
Patent Abstracts of Japan, Publication No. 2005-221525; Publication Date: Aug. 18, 2005; in the name of Tada et al.
Office action issued by the State Intellectual Property Office of P.R. China on Jan. 20, 2008 for related Application No. 200610138192.8 indicating relevance of reference cited herein.

* cited by examiner

*Primary Examiner*—Amare Mengistu
*Assistant Examiner*—Insa Sadio
(74) *Attorney, Agent, or Firm*—Christie, Parker & Hale, LLP

(57) ABSTRACT

An electron emission display device and a method of correcting an image signal to enhance an image quality by reducing luminance unevenness among pixels. The display device includes: a display region having an anode electrode configured to collide with electrons emitted depending on a voltage applied to first and second electrodes, the image signal being corrected using a correction factor; an image signal generator for generating the corrected image signal by multiplying the image signal by the correction factor to generate a result, dividing the result by a first number to generate a quotient and a remainder, and summing the quotient with a second number corresponding to a value of the remainder; a data driver for generating a data signal using the image signal and for transferring the data signal to the first electrode; and a scan driver for generating and transferring a scan signal to the second electrode.

20 Claims, 5 Drawing Sheets

ELECTRON EMISSION DISPLAY DEVICE AND VIDEO DATA REVISION METHOD

CROSS-REFERENCE TO RELATED APPLICATION

This application claims priority to and the benefit of Korean Patent Application No.

10-2006-0032074, filed on Apr. 07, 2006, in the Korean Intellectual Property Office, the entire content of which is incorporated herein by reference.

BACKGROUND

1. Field of the Invention

The present invention relates to an electron emission display device and a method of correcting an image signal, and more specifically to an electron emission display device and a method of correcting an image signal to enhance an image quality by reducing or preventing luminance unevenness among pixels.

2. Discussion of Related Art

In general, electron emitting parts used for electron emission display devices can be classified into electron emitting parts in which hot cathode rays are used as electron sources and electron emitting parts in which cold cathode rays are used as electron sources. The electron emitting parts in which the cold cathodes are used include field emitter array (FEA) type electron emitting parts, surface conduction emitter (SCE) type electron emitting parts, metal-insulator-metal (MIM) type electron emitting parts, metal-insulator-semiconductor (MIS) type electron emitting parts, and ballistic electron surface emitting (BSE) type electron emitting parts.

The FEA type of the electron emission display device uses a principle that emits electrons by electric field difference in vacuum by using materials with a low work function or a high β function as an electron emission source, wherein any device using a tip structure of which leading is sharp or carbon-based materials or nano-based materials as an electron emission source is developing.

The SCE type of the electron emission display device is a device that an electron emitting part is formed by providing a conductive thin film between two electrodes arranged to be opposed to each other on a substrate and finely cracking the conductive thin film. The device uses a principle that voltage is applied to the electrodes to flow current onto the surface of the conductive thin film, thereby emitting electrons from the electron emitting part being a fine gap.

The MIM and the MIS types of the electron emission display devices form electron emitting parts configured of a metal-insulator metal (MIM) and a metal-insulator-semiconductor (MIS) structures, respectively, wherein it is a device using a principle that when voltage is applied to two metals having an insulator positioned therebetween or between a metal and a semiconductor, electrons are emitted by moving and accelerating them from the metal and the semiconductor having a high electron potential to the metal having a low electron potential.

The BSE type of the electron emission display device is a device emitting electrons by forming an electron supplying layer configured of a metal or a semiconductor on an ohmic electrode and forming an isolating layer and a metal thin film on the electron supplying layer, and then applying a power source to the ohmic electrode and the metal thin film, using a principle traveling without scattering electrons in the case that the size of the semiconductor is reduced up to a dimensional range smaller than an average free stroke of electrons.

Such electron emission display devices can be used in various fields and have vigorously been studied up to recently, due to advantages that likewise a cathode-ray-tube (CRT), it is operated by light-emitting a cathode electrode wire (self-light source, high efficiency, high luminance and wide luminance range, natural color and high color purity, wide viewing angle), and its operation speed and operation temperature range, etc., are wide.

FIG. 1 is a structural view illustrating a conventional electron emission display device. Referring to FIG. 1, the electron emission display device includes a display region 10, a data driver 20, a scan driver 30, and a timing controller 40.

In the display region 10, pixels 10 are located at regions defined by the crossings (or intersections) of cathode electrodes C1, C2, . . . , Cm and gate electrodes G1, G2, . . . , Gn. The pixels 10 include electron emitting parts so that electrons emitted from the electron emitting parts on the cathode electrodes collide with an anode electrode having a high voltage level to light-emit phosphors for displaying an image. The gray levels of images displayed vary depending on input digital image signal values. To control the gray levels represented depending on the digital image signal values, a pulse width modulation scheme can be used. The pulse width modulation scheme is a scheme to control a time period that a data signal of a constant voltage is applied to one or more of the cathode electrodes such that a long time period is used to represent a high gray level and a short time period is used to represent a low gray level.

The data driver 20 uses an image signal to generate a data signal and is connected to the cathode electrodes C1, C2, . . . , Cm to transfer the data signal to the display region 10 so that the display region 10 is light-emitted depending on the data signal.

The scan driver 30 is connected to the gate electrodes G1, G2, . . . , Gn to generate a scan signal and transfers it to the display region 10 so that the display region 10 is sequentially light-emitted using a line scan scheme in units of horizontal lines with uniform time period to display an entire image on the display region 10.

The timing controller 40 transfers an image signal, a data driver controlling signal, a scan driver controlling signal, etc., to the data driver 20 and the scan driver 30 to operate the data driver 20 and the scan driver 30 to display an image on the display region 10.

In an electron emission display device as described above, a plurality of electron emitting parts are positioned at a plurality of pixels, respectively, and the luminance of the pixels depends on the amount of electrons emitted from the plurality of electron emitting parts. However, the electron emitting parts may be non-uniformly manufactured to cause the amount of electrons emitted from each of the electron emitting parts to be different even when the same image signal is input into each of the electron emitting parts, resulting in that the luminance of each of the pixels is different.

SUMMARY OF THE INVENTION

It is an aspect of the present invention to provide an electron emission display device and a method of correcting an image signal to enhance an image quality by reducing or preventing a luminance unevenness of pixels.

A first embodiment of the present invention provides an electron emission display device including: a display region having an anode electrode configured to have a high voltage level and to collide with electrons emitted depending on a voltage applied to a first electrode (e.g., a cathode electrode) and a second electrode (e.g., a gate electrode), wherein an image signal of n bits is corrected using a correction factor of n bits to compensate luminance differences among a plurality of pixels; an image signal generator for generating the corrected image signal by multiplying the image signal of n bits by the correction factor of n bits to generate a result, dividing the result by a first number to generate a quotient and a remainder, and summing the quotient with a second number corresponding to a value of the remainder; a data driver for generating a data signal using the corrected image signal and for transferring the data signal to the first electrode; and a scan driver for generating a scan signal and for transferring the scan signal to the second electrode.

A second embodiment of the present invention provides an electron emission display device including: a display region having an anode electrode configured to have a high voltage level and to collide with electrons emitted depending on a voltage applied to a first electrode and a second electrode, wherein an image signal of n bits is corrected by using a correction factor of n bits to compensate luminance differences among a plurality of pixels; an image signal generator for generating the corrected image signal by multiplying the image signal of n bits by the correction factor of n bits to generate a result, dividing the result by a first number to generate a first quotient and a first remainder, dividing the first remainder by the first number to generate a second quotient, and summing the first quotient with a second number corresponding to the second quotient; a data driver for generating a data signal using the corrected image signal and for transferring the data signal to the first electrode; and a scan driver for generating a scan signal and for transferring the scan signal to the second electrode.

A third embodiment of the present invention provides a method of correcting an image signal including the steps of: generating a correction signal of 2n bits by multiplying an image signal of n bits by a correction factor of n bits; generating a quotient and a remainder by dividing the correction signal of 2n bits; generating an error by summing the quotient and the remainder; rounding the error; and generating the corrected image signal by summing the quotient with the rounded error.

A fourth embodiment of the present invention provides a method of correcting an image signal including the steps of: generating a correction signal by multiplying an image signal by a correction factor; generating a first quotient and a first remainder by dividing the correction signal by a first number; and generating a second quotient and a second remainder by dividing the first remainder by the first number and generating the corrected image signal by summing the first quotient with a second number based on a value of the second quotient.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

In the following detailed description, only certain exemplary embodiments of the present invention are shown and described, by way of illustration. As those skilled in the art would recognize, the described exemplary embodiments may be modified in various ways, all without departing from the spirit or scope of the present invention. Accordingly, the drawings and description are to be regarded as illustrative in nature, and not restrictive.

Figure 1:
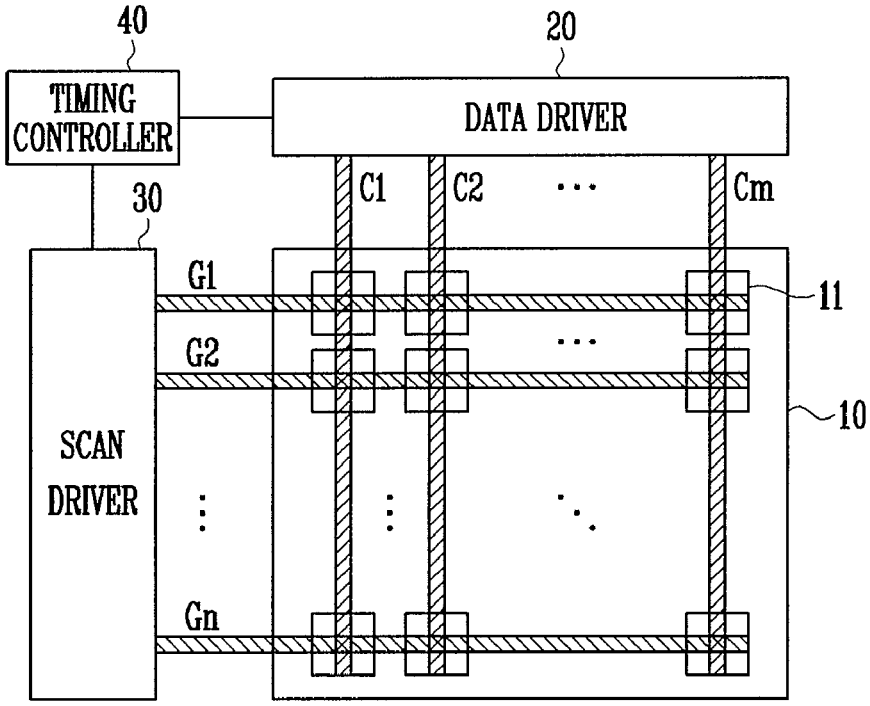
FIG. 1 (PRIOR ART)
FIG. 1 is a structural view illustrating a conventional electron emission display device.
Figure 2:
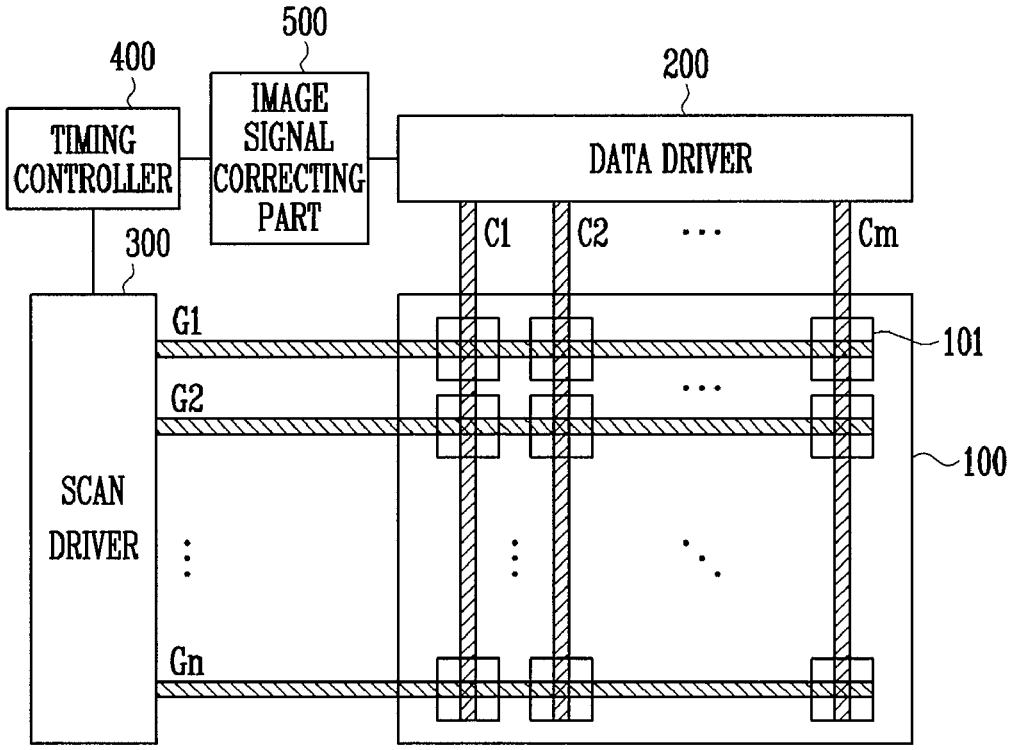
FIG. 2 is a structural view illustrating an electron emission display device according to an embodiment of the present invention.

FIG. 2 is a structural view for illustrating an electron emission display device according to an embodiment of the present invention. Referring to FIG. 2, the electron emission display device includes a display region 100, a data driver 200, a scan driver 300, a timing controller 400, and an image signal correcting part 500.

In the display region 100, pixels 101 are located at regions defined by the crossings (or intersections) of cathode electrodes C1, C2, . . . , Cm and gate electrodes G1, G2, . . . , Gn. The pixels 101 include electron emitting parts so that electrons emitted from the electron emitting parts on the cathode electrodes collide with an anode electrode having a high voltage level to light-emit phosphors for displaying an image. The gray levels of images displayed vary depending on input digital image signal values. To control the gray levels represented depending on the digital image signal values, a pulse width modulation scheme can be used.

The data driver 200 uses an image signal to generate a data signal and is connected to the cathode electrodes C1, C2, . . . , Cm to transfer the data signal to the display region 100 so that the display region 100 is light-emitted depending on the data signal.

The scan driver 300 is connected to the gate electrodes G1, G2, . . . , Gn to generate a scan signal and transfers it to the display region 100 so that the display region 100 is sequentially light-emitted using a line scan scheme in units of horizontal lines with uniform time period to display an entire image on the display region 100.

The timing controller 400 transfers an image signal, a data driver controlling signal, a scan driver controlling signal, etc., to the data driver 200 and the scan driver 300 to operates the data driver 200 and the scan driver 200 to display an image on the display region 100.

The image signal correcting part 500 corrects the image signal transferred from the timing controller 400 and transfers it to the data driver to generate a corrected data signal in the data driver 300 using the corrected image signal, wherein the image correcting part 500 corrects the image signal depending on deviations of the amount of electrons emitted from each of the electron emission parts. For example, if first, second, third, and fourth pixels were all to be light-emitted by corresponding image signals each having a gray level of 255, but actually light-emit the gray levels of 255, 232, 210 and 204, respectively, spots appear on the display region 100 due to luminance unevenness among respective pixels. As such, to reduce or prevent a luminance unevenness of the display region 100, each of the corresponding image signals of the pixels light-emitting the gray levels of 255, 232, 210 and 204 is multiplied by a different correction factor such that the pixels represent the gray level of 204 as a whole.

Table 1 represents a pixel having a correction factor for representing a maximum gray level of 204, and input gray levels of 9, 16, 226, 234, 242 of image signals input to the pixel that has been corrected to have a compensating ratio of 80% for the input gray levels of 9, 16, 226, 234, 242.

TABLE 1

| Input gray levels | Correction factors * Input gray levels | Computing results(binary number) | Upper 8 bits | Lower 8 bits | Original compensation | errors |
|---|---|---|---|---|---|---|
| 9 | 1836 | 0000011100101100 | 00000111 | 00101100 | 7.2 | 0.2 |
| 16 | 3264 | 0000011100101100 | 00000111 | 00101100 | 12.9 | 0.8 |
| 226 | 46104 | 1011010000011000 | 10110100 | 00011000 | 180.8 | 0.8 |
| 234 | 47736 | 1011101001111000 | 10111010 | 01111000 | 187.2 | 1.2 |
| 242 | 49368 | 1100000011011000 | 11000000 | 11011000 | 193.6 | 1.6 |

Figure 3:
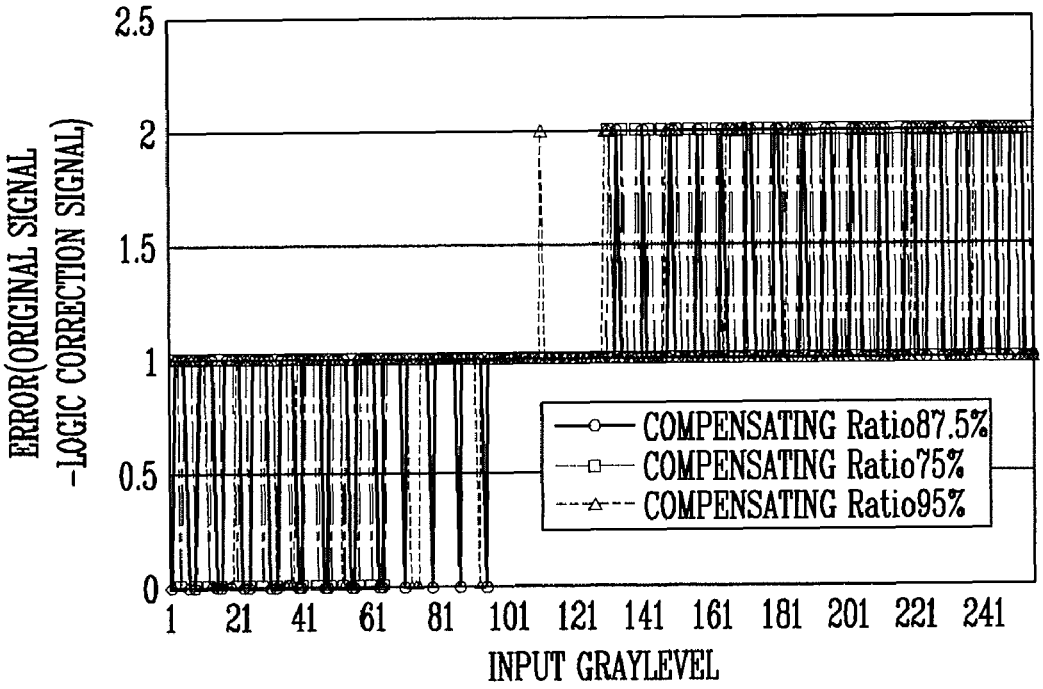
FIG. 3 is a graph illustrating errors according to gray levels in a case of correcting image signals using quotients generated by a dividing operation in an image signal correcting process.

First, if the input gray level is 9, the result of multiplying the correction factor with the input gray level is 1836, and a binary representation of this result is 0000011100101100. Here, by removing lower 8 bits in this result, the decimal representation of the result, i.e., 1836, is divided by 256. The upper (or uppermost) 8 bits, i.e., 00000111, are presented into a decimal number as 7. However, since the 80% of the input gray level 9 is actually 7.2, there is an error of 0.2. If the input gray level is 16, the upper 8 bits are 12, while the 80% of the input gray level is 12.8. As a result, there is an error of 0.8. If the input gray level is 226, there is an error of 0.8; if the input gray level is 234, there is an error of 1.2; and if the input gray level is 242, there is an error of 1.6. If the errors of 0 to 255 gray levels are calculated in such manners, the errors have values ranging from 0 to 2 corresponding to the gray scale values as illustrated in FIG. 3. FIG. 3 illustrates the errors having values ranging from 0 to 2 independently of the correction factors corrected (or compensated) to have compensating ratios of 87.5%, 75% and 95% for the gray levels ranging from 0 to 255. As shown, since the sizes of the errors are different for every gray level, when correcting the gray scale value of the image signal merely by the division scheme as described above, the luminance differences among the pixels are reduced but the luminance differences among the pixels still differ by a range from 0 to 2 due to the sizes of the different errors. In particular, in a case of a gray level of a high luminance, the size of the difference becomes greater than in a case of a gray level of a low luminance.

Figure 4:
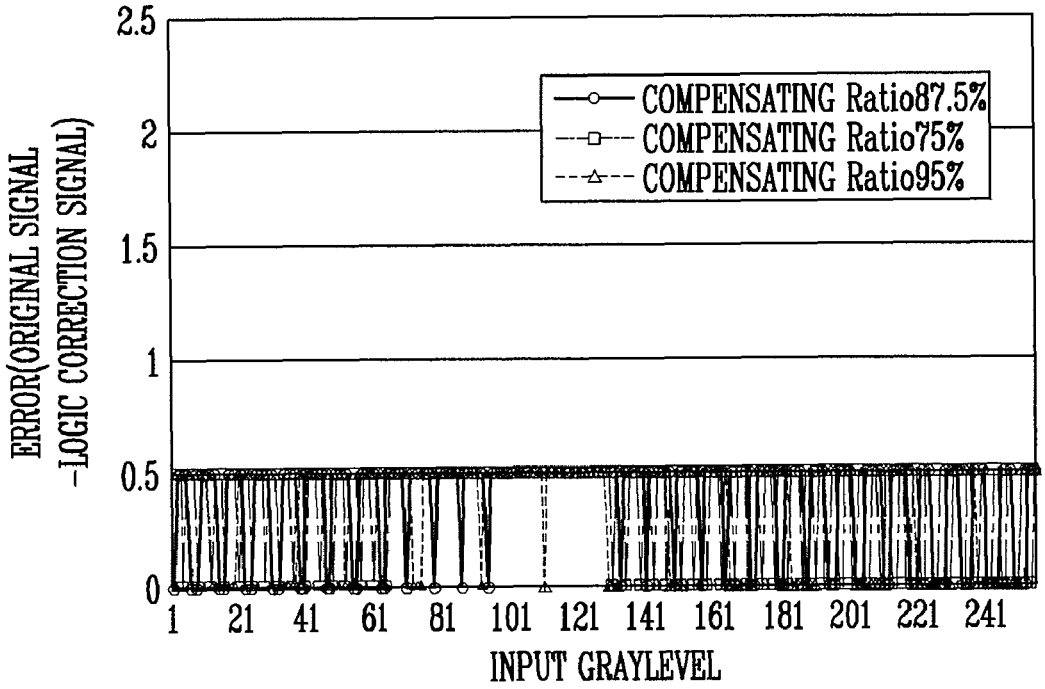
FIG. 4 is a graph illustrating errors according to gray levels in a case of correcting image signals using quotients and remainders generated by a dividing operation in an image signal correcting process.

Therefore, as an enhancement of the above division scheme, after rounding the error, the error rounded is added to the corrected input gray level. That is, if the input gray level is 9, the error is 0.2 so that the error rounded is 0. If this rounded error 0 is added to the corrected input gray level 7, it is still 7 and if the input gray level is corrected using 7, there is an error of 0.2, which is the same as the original compensation. However, if the input gray level is 16, the error is 0.8 so that the error rounded is 1 and if the rounded error 1 is added to the corrected input gray level 12, it becomes 13 so that there is only a 0.2 error (or difference) from 12.8, thereby reducing the error from 0.8 to 0.2. Likewise, if the input gray level is 226, the error is reduced from 0.8 to 0.2; if the input gray level is 234, the error is reduced from 1.2 to 0.2; and if the input gray level is 242, the error is reduced from 1.6 to 0.4. That is, the range of the errors in 0 to 255 gray levels is reduced to values ranging from 0 to 0.5 as illustrated in FIG. 4 so that luminance unevenness among the pixels differs by a range from 0 to 0.5, resulting in a reduction of the luminance unevenness among the pixels as compared with FIG. 3. That is, FIG. 4 illustrates the errors having values ranging from 0 to 0.5 independently of the correction factors corrected (or compensated) to have compensating ratios of 87.5%, 75% and 95% for the gray levels ranging from 0 to 255 using a rounding process that rounds a remainder to reduce an error.

Further, the image signal correcting part 500 is illustrated as a separate part in FIG. 2; however, the present invention is not thereby limited and the correcting part 500 may be included in the data driver 200 and/or the timing controller 400.

Figure 5:
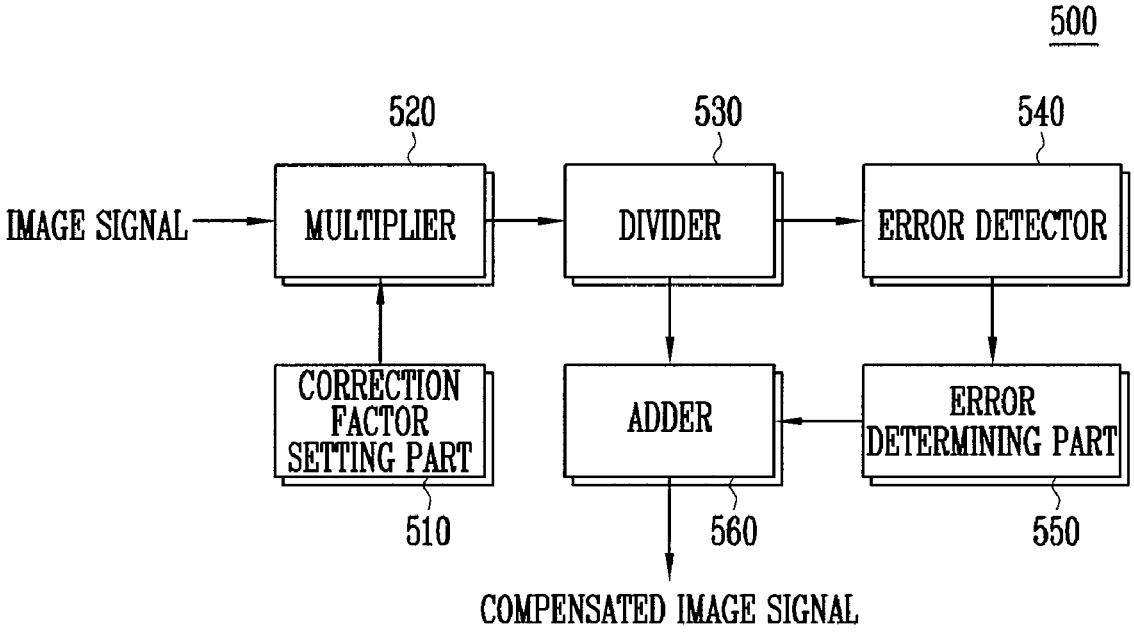
FIG. 5 is a block diagram illustrating an embodiment of an image signal correcting part of the electron emission display device illustrated in FIG. 2.
Figure 6:
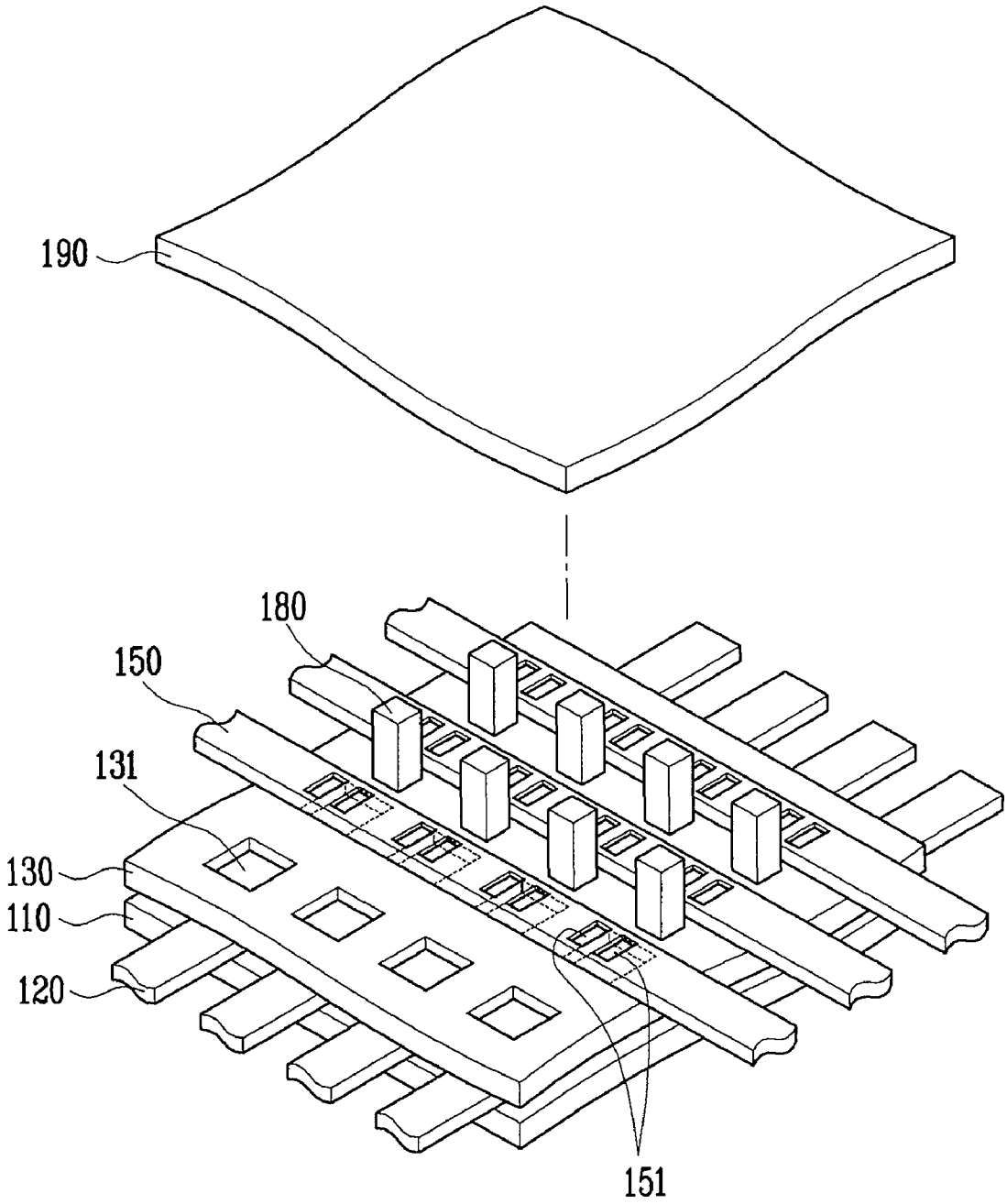
FIG. 6 is a perspective view illustrating a display region of the electron emission display device illustrated in FIG. 2.
Figure 7:
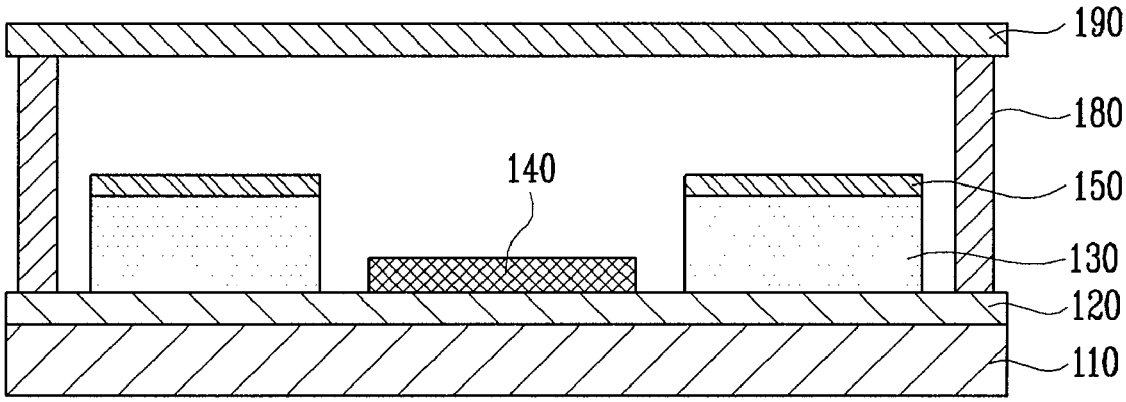
FIG. 7 is a sectional view illustrating the display region of the electron emission display device illustrated in FIG. 2.

FIG. 5 is a structural view block diagram illustrating an embodiment of an image signal correcting part of the electron emission display device illustrated in FIG. 2. Referring to FIG. 5, the image signal correcting part 500 includes a correction factor setting part 510, a multiplier 520, a divider 530, an error detector 540, an error determining part 550, and an adder 560.

The correction factor setting part 510 stores correction factors of n bits corresponding to each of the pixels so that the pixels are light-emitted corresponding to each of the different correction factors associated with a each of the pixels.

The multiplier 520 receives gray scale values of image signals of n bits and the correction factors of n bits stored in the correction factor setting part 510 to process (or multiply) the gray scale values of the image signals and (or with) the correction factors, thereby generating correction signals of 2n bits.

The divider 530 receives the correction signals of 2n bits and separates them into the upper n bits and the lower n bits. Separating the correction signals of 2n bits into the upper n bits and the lower n bits is performed by dividing the correction signals by n bits, wherein the upper n bits become the quotients generated by the division and the lower n bits become the remainders generated by the division.

The error detector 540 sums the upper n bits and the lower n bits of the divider to detect the errors of n+1 bits. That is, the error detector 540 operates using each input gray level, if the input gray level is 9, the value of the upper 8 bits is 00000111 and the value of the lower 8 bits is 00101100. If the upper 8 bits and the lower 8 bits are summed, the result is 00110011 and if it is to be the error of 9 bits, it is 000110011. If the input gray level is 16, the value of the upper 8 bits is 00001100 and the value of the lower 8 bits is 11000000. And, if the upper 8 bits and the lower 8 bits are summed, the result is 11001100 and if it is to be the error of 9 bits, it is 011001100. If the input gray level is 226, the value of the upper 8 bits is 10110100 and the value of the lower 8 bits is 00011000. If the upper 8 bits and the lower 8 bits are summed, the result becomes 11001100 and if it is to be the error of 9 bits, it is 011001100. If the input gray level is 234, the value of the upper 8 bits is 10111010 and the value of the lower 8 bits is 01111000. If the upper 8 bits and the lower 8 bits are summed to be the error of 9 bits, it becomes 100110010 of 9 bits and the error of 9 bits. Also, if the input gray level is 242, the value of the upper 8 bits is 11000000 and the value of the lower 8 bits is 11011000. If the upper 8 bits and the lower 8 bits are summed to be the error of 9 bits, it becomes 110011000 of 9 bits and the error of 9 bits.

The error determining part 550 rounds errors using the upper (or uppermost) 2 bits in the errors of n+1 bits generated from the error detector 540. If the upper 2 bits are 00, the error is determined to be 0 and if the upper 2 bits are 01 or 10, the error is determined to be 1. If the upper 2 bits are 11, the error is determined to be 2.

If the input gray level of the image signal is 9, the value of the upper 2 bits in the error of 9 bits is 00 so that the error is determined to be 0 by the error detector 540. If the input gray level of the image signal is 16, the value of the upper 2 bits in the error of 9 bits is 01 so that the error is determined to be 1 by the error detector 540. If the input gray level of the image signal is 226, the value of the upper 2 bits in the error of 9 bits is 01 so that the error is determined to be 1. If the input gray level of the image signal is 234, the value of the upper 2 bits in the error of 9 bits is 10 so that the error is determined to be 1. If the input gray level of the image signal is 242, the value of the upper 2 bits in the error of 9 bits is 11 so that the error is determined to be 2.

The adder 560 generates compensated image signal corrected by summing the errors determined using the upper bits in the divider 530 and the upper 2 bits in the error determining part 550. If the input gray level of the image signal is 9, the upper 8 bits become the quotient of the dividing operation and if the upper 8 bits are represented as a decimal number, it becomes 7 and the error determined in the error determining part 550 becomes 0 so that the image signal is corrected to 7 from 9. Here, 80% of 9 should actually be 7.2 so that there is a 0.2 difference from the actual value. In case the input gray level of the image signal is 16, if the upper 8 bits are represented as a decimal number, it becomes 12 and the error determined in the error determining part 550 becomes 1 so that the image signal is represented as 13 from 16. Here, 80% of 16 should actually be 12.8 so that there is a 0.2 difference from the actual value. In case the input gray level of the image signal is 226, if the upper 8 bits are represented as a decimal number, it becomes 180 and the error determined in the error determining part 550 becomes 1 so that the image signal is represented as 181 from 226. Here, 80% of 226 should actually be 180.8 so that there is a 0.2 difference from the actual value. In case that the input gray level of the image signal is 234, if the upper 8 bits are represented as a decimal number, it becomes 186 and the error determined in the error determining part 550 becomes 1 so that the image signal becomes 187 from 234. Here, 80% of 186 should actually be 187.2 so that there is a 0.2 difference from the actual value. In case that the input gray level of the image signal is 242, if the upper 8 bits are represented as a decimal number, it becomes 192 and the error determined in the error determining part 550 becomes 2 so that the image signal becomes 194 from 242. Here, 80% of 242 should actually be 193.6 so that there is a 0.4 differences from the actual value. As a result, the errors of the image signals are corrected to have error values that are below 0.5.

With an electron emission display device and a method of correcting image signals according to an embodiment of the present invention, in a correcting process of reducing values of the image signals at a constant ratio (or a constant compensating ratio) by a dividing operation, the correcting process rounds and corrects errors generated from remainders caused by the dividing operation, thereby reducing errors of the corrected image signals and further reducing the luminance difference among pixels associated with the corrected image signals to enhance the image quality.

While the invention has been described in connection with certain exemplary embodiments, it is to be understood by those skilled in the art that the invention is not limited to the disclosed embodiments, but, on the contrary, is intended to cover various modifications included within the spirit and scope of the appended claims and equivalents thereof.

What is claimed is:

1. An electron emission display device comprising:

a display region comprising an anode electrode configured to have a high voltage level and to collide with electrons emitted depending on a voltage applied to a first electrode and a second electrode, wherein an image signal of n bits is corrected using a correction factor of n bits to compensate luminance differences among a plurality of pixels;

an image signal generator for generating the corrected image signal by multiplying the image signal of n bits by the correction factor of n bits to generate a result, dividing the result by a first number to generate a quotient and a remainder, and summing the quotient with a second number corresponding to a value of the remainder;

a data driver for generating a data signal using the corrected image signal and for transferring the data signal to the first electrode; and a scan driver for generating a scan signal and for transferring the scan signal to the second electrode.

2. The device according to claim 1, wherein the second number comprises a number selected from the group consisting of 0, 1, and 2.

3. The device according to claim 1, wherein the first number corresponds to the highest gray level of a gray scale of the image signal of n bits.

4. The device according to claim 1, wherein the first number is 256.

5. The device according to claim 1, wherein an image signal correcting part comprises:

a correction factor setting part for storing the correction factor of n bits corresponding to each of the pixels;

a multiplier for multiplying the correction factor of n bits by the input gray level of the image signal of n bits to generate a correction signal of 2n bits;

a divider for dividing the correction signal of 2n bits by the first number;

an error detector for receiving and summing the quotient and the remainder of the correction signal to generate n+1 data;

an error determining part for determining the second number through the uppermost 2 bits of the n+1 data generated from the error detector; and an adder for summing the quotient with the second number determined in the error determining part to generate the corrected image signal.

6. The device according to claim 5, wherein if the uppermost 2 bits of the n+1 data is 00, the second number is determined by the error determining part to be 0; if the uppermost 2 bits of the n+1 data is 01, the second number is determined by the error determining part to be 1; if the uppermost 2 bits of the n+1 data is 10, the second number is determined by the error determining part to be 1; and if the uppermost 2 bits of the n+1 data is 11, the second number is determined by the error determining part to be 2.

7. The device according to claim 1, wherein an error of the corrected image signal ranges from 0 to 0.5.

8. The device according to claim 1, wherein the image signal comprises a plurality of image signals, and wherein the correction factor comprises a plurality of correction factors.

9. An electron emission display device comprising:

a display region comprising an anode electrode configured to have a high voltage level and to collide with electrons emitted depending on a voltage applied to a first electrode and a second electrode, wherein an image signal of n bits is corrected by using a correction factor of n bits to compensate luminance differences among a plurality of pixels;

an image signal generator for generating the corrected image signal by multiplying the image signal of n bits by the correction factor of n bits to generate a result, dividing the result by a first number to generate a first quotient and a first remainder, dividing the first remainder by the first number to generate a second quotient, and summing the first quotient with a second number corresponding to the second quotient;

a data driver for generating a data signal using the corrected image signal and for transferring the data signal to the first electrode; and a scan driver for generating a scan signal and for transferring the scan signal to the second electrode.

10. The device according to claim 9, wherein the first number corresponds to the highest gray level of a gray scale of the image signal of n bits.

11. The device according to claim 9, wherein the image signal comprises a plurality of image signals, and wherein the correction factor comprises a plurality of correction factors.

12. A method of correcting an image signal, the method comprising:

generating a correction signal of 2n bits by multiplying an image signal of n bits by a correction factor of n bits;

generating a quotient and a remainder by dividing the correction signal of 2n bits;

generating an error by summing the quotient and the remainder;

rounding the error; and generating the corrected image signal by summing the quotient with the rounded error.

13. The method according to claim 12, wherein the generating the error comprises summing the quotient and the remainder to generate a summed number and then summing the quotient with a first number corresponding to the number of the uppermost 2 bits of the summed number.

14. The method according to claim 12, wherein if the uppermost 2 bits of the summed number is 00, the first number is determined by to be 0; if the uppermost 2 bits of the summed number is 01, the first number is determined to be 1; if the uppermost 2 bits of the summed number is 10, the first number is determined to be 1; and if the uppermost 2 bits of the summed number is 11, the first number is determined to be 2.

15. The method according to claim 12, wherein the quotient has n bits and the remainder also has n bits.

16. The method according to claim 12, wherein the image signal comprises a plurality of image signals, and wherein the correction factor comprises a plurality of correction factors.

17. A method of correcting an image signal, the method comprising:

generating a correction signal by multiplying an image signal by a correction factor;

generating a first quotient and a first remainder by dividing the correction signal by a first number; and generating a second quotient and a second remainder by dividing the first remainder by the first number and generating the corrected image signal by summing the first quotient with a second number based on a value of the second quotient.

18. The method according to claim 17, wherein the second number comprises a number selected from the group consisting of 0, 1, and 2.

19. The method according to claim 17, wherein the image signal comprises a plurality of image signals, and wherein the correction factor comprises a plurality of correction factors.

20. The method according to claim 17, wherein the first number corresponds to the highest gray level of a gray scale of the image signal.

* * * * *